US007350372B2

(12) United States Patent
Wells

(10) Patent No.: US 7,350,372 B2
(45) Date of Patent: Apr. 1, 2008

(54) SYSTEM AND METHOD FOR SELECTIVE HEATING AND COOLING

(76) Inventor: David N. Wells, 10802 E. Nolcrest Dr., Silver Spring, MD (US) 20903

( * ) Notice: Subject to any disclaimer, the term of this patent is extended or adjusted under 35 U.S.C. 154(b) by 425 days.

(21) Appl. No.: 10/910,294

(22) Filed: Aug. 4, 2004

(65) Prior Publication Data

US 2005/0086971 A1 Apr. 28, 2005

Related U.S. Application Data

(60) Provisional application No. 60/571,938, filed on May 18, 2004, provisional application No. 60/562,546, filed on Apr. 16, 2004, provisional application No. 60/543,929, filed on Feb. 13, 2004, provisional application No. 60/523,679, filed on Nov. 21, 2003, provisional application No. 60/513,999, filed on Oct. 27, 2003.

(51) Int. Cl.
*F25B 13/00* (2006.01)

(52) U.S. Cl. ..... 62/324.1; 62/238.5

(58) Field of Classification Search ..... 62/86, 62/93, 176.1, 238.5, 332, 408
See application file for complete search history.

(56) References Cited

U.S. PATENT DOCUMENTS

| | | | | |
|---|---|---|---|---|
| 4,009,575 | A * | 3/1977 | Hartman et al. | 60/648 |
| 4,526,013 | A * | 7/1985 | Joy | 62/236 |
| 4,562,995 | A * | 1/1986 | Enjo et al. | 252/67 |
| 4,903,503 | A * | 2/1990 | Meckler | 62/238.3 |
| 5,181,387 | A * | 1/1993 | Meckler | 62/59 |
| 5,555,731 | A * | 9/1996 | Rosenblatt | 60/671 |
| 5,823,008 | A * | 10/1998 | Nikai et al. | 62/401 |
| 6,481,216 | B2 * | 11/2002 | Simmons et al. | 62/6 |
| 6,532,749 | B2 * | 3/2003 | Rudick et al. | 62/6 |
| 7,049,465 | B2 * | 5/2006 | Lin | 562/414 |

* cited by examiner

*Primary Examiner*—Melvin Jones
(74) *Attorney, Agent, or Firm*—Rosenberg, Klein & Lee

(57) ABSTRACT

A combined heating/cooling system and method is provided wherein an absorption tank (20) houses a refrigerant and absorbant mixture composition. A boiler (50) heats the high pressure mixture composition and vaporizes the refrigerant. Heated absorbant is passed back through a heat exchanger (40) to be delivered back into absorption tank (20) and the vaporized refrigerant is directed to a closed-loop thermal exchange system for selectively heating and cooling ambient air. The refrigerant and absorbant mixture composition is preferably Genosorb® 1843 and HCFC-124.

11 Claims, 5 Drawing Sheets

SYSTEM AND METHOD FOR SELECTIVE HEATING AND COOLING

REFERENCE TO RELATED APPLICATIONS

This Patent Application is based upon Provisional Applications Ser. No. 60/543,929, filed on 13 Feb. 2004; Ser. No. 60/571,938, filed 18 May 2004; Ser. No. 60/562,546, filed 16 Apr. 2004; Ser. No. 60,523,679 filed 21 Nov. 2003; and Ser. No. 60/513,999 filed on 27 Oct. 2003

BACKGROUND OF THE INVENTION

1. Field of the Invention

The subject invention relates to a system and method for selective heating and cooling. In particular, the present invention directs itself to a system utilizing a refrigerant and absorbant mixture composition held within an absorption tank. More particularly, a boiler is provided for heating the mixture composition such that the boiler vaporizes the refrigerant and the liquid absorbant is delivered back into the absorption tank for reuse. Further, the vaporized refrigerant is delivered to a closed-loop thermal exchange system for selectively heating and cooling ambient air.

The present invention system and method further directs itself to providing a novel mixture of refrigerants and an absorbant composition allowing the system to act as both a heating and cooling system. More particularly, the mixture of refrigerants and the absorbant provide an environmentally friendly composition, which further allows the system to be hermetically sealed. Additionally, the heating and cooling system may further be utilized as a power generation system.

2. Prior Art

Heating and cooling systems are well-known in the art. In general, such prior art systems generally utilize two different sets of heating and cooling sub-systems. The system of the subject Patent Application, however, provides for a single closed-loop thermal exchange system allowing selection of a heating cycle or a cooling cycle, and utilizing the same components. The system is sealed and utilizes heating/cooling solution mixtures which may be reused in the heating and cooling cycles.

Given present thermal exchange systems, a need exists in the market for a system that produces a heat pump or cooling effect, or both electric power and a cooling effect utilizing heat input. The system should be both efficient and inexpensive. A key element of such a system would be that it would use substantially "off the shelf" components. For example, stock automotive fuel pumps might act as a system liquid pump. Stock air conditioning electric refrigeration compressors, particularly of the scroll type, might act as the system expander/power producing element if the scroll compressor is modified simply by removing the check valve used in an air conditioning service.

The present invention system concept is directed to such a system utilizing "off-the-shelf" components and, in particular, is directed at a novel and unique selection of working fluid and absorption materials which are compatible with the system components.

Systems utilizing scroll compressors which are run in reverse as expansion engines, and systems utilizing isoparaffins as absorption materials for use with butane refrigerants, are well-known in the art. The present system provides an improvement over both of these prior art systems in that it prevents a system which is a hybrid or combined absorption refrigeration system and an electric power system. The electric power is produced simultaneously with a cooling or refrigeration effect. Furthermore, the system provides working fluid refrigerants which are non-flammable and absorption materials which have an advantageously high boiling point.

The present invention system concept improves on prior art systems in that the refrigerant and absorption materials are chemically non-reactive with materials of construction of wetted rotor type electric motors and generators, thus allowing the system to be hermetically sealed. This is not possible with absorption mixtures of the previously known types, such as amides, which are electrically conductive and which attack insulation in motors. Furthermore, the refrigerants utilized by this system are non-flammable, thus improving safety.

SUMMARY OF THE INVENTION

The present invention provides for a combined heating/cooling system. The heating/cooling system utilizes a refrigerant and absorbant mixture composition held, initially, in an absorption tank. A pump in fluid communication with the absorption tank pressurizes the mixture composition and delivers it to a first heat exchanger. A boiler is provided for receiving the high pressure mixture composition, with the boiler vaporizing the refrigerant and delivering the liquid absorbant back into the absorption tank for later reuse. The vaporized refrigerant is delivered to a closed-loop thermal exchange system for selective heating and cooling of ambient air.

It is a principal objective of the subject heating/cooling system to provide an optimized refrigerant and absorbant mixture composition.

It is a further objective of the subject heating/cooling system to provide a boiler for heating a high pressure mixture composition in order to vaporize the refrigerant component of the mixture.

It is a further objective of the subject invention to provide means for retrieving the liquid absorbant from the boiler in order to reuse the absorbant in the absorbant/refrigerant mixture.

It is an important objective of the present invention to provide a closed-loop thermal exchange system for selectively heating and cooling ambient air.

DESCRIPTION OF THE PREFERRED EMBODIMENTS

I. Overview

Figure 2:
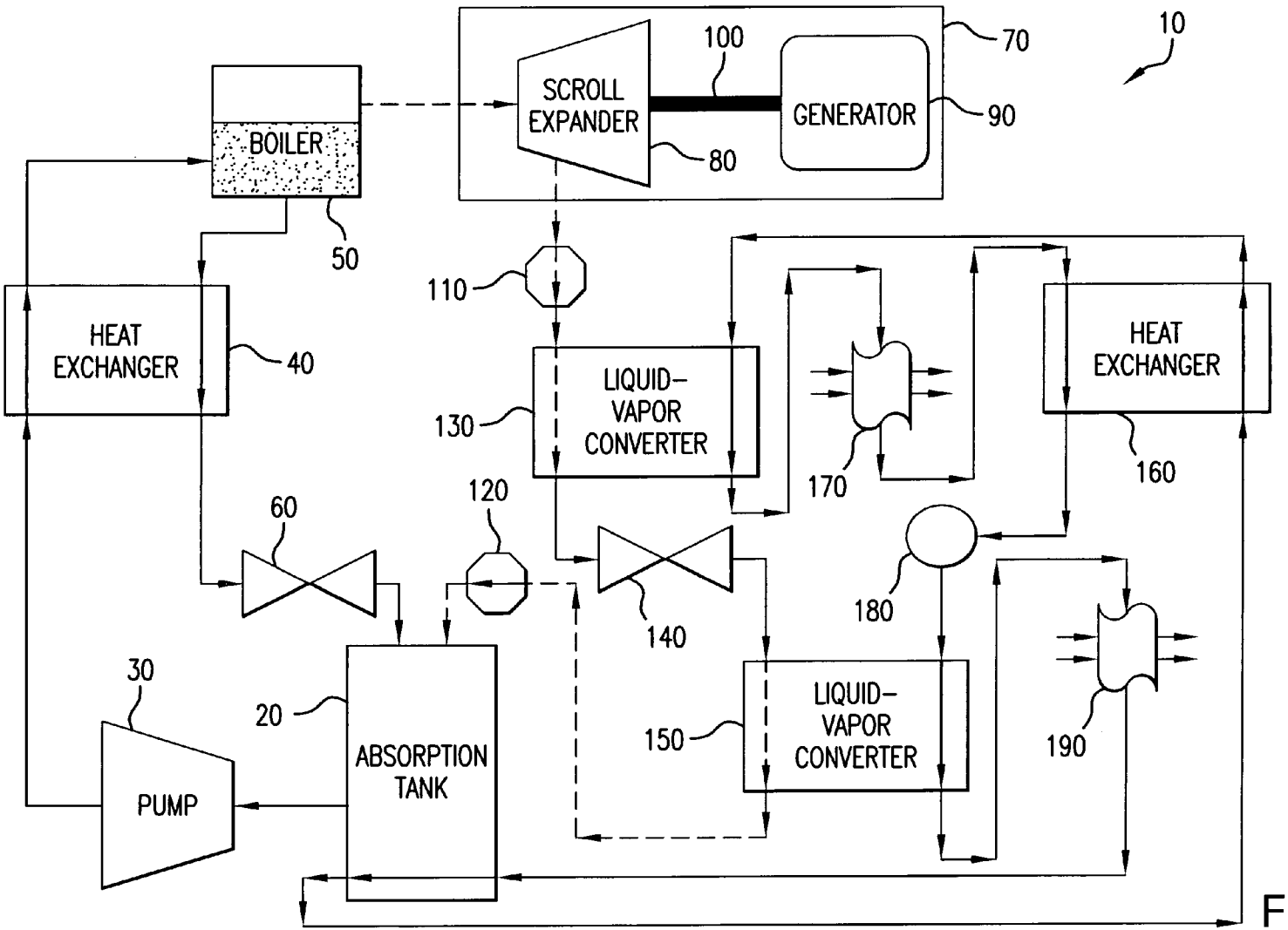
FIG. 2 is a schematic representation of an alternative embodiment of the subject heating/cooling system in a cooling cycle.
Figure 3:
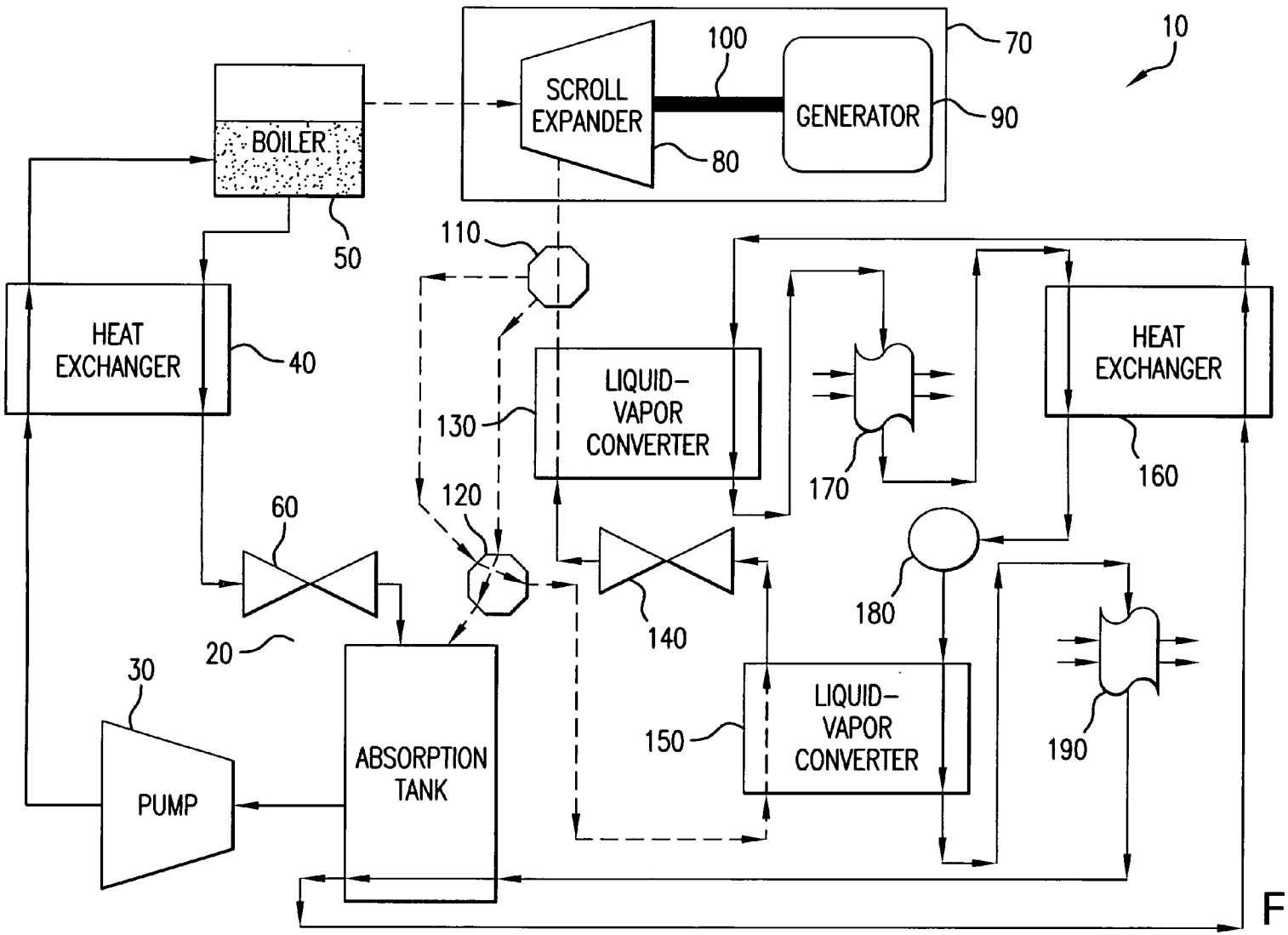
FIG. 3 is a schematic diagram of an alternative embodiment of the subject heating/cooling system in a heating cycle.

Referring to FIGS. 2 and 3 of the Drawings, there is shown a system for combined heating/cooling of an edifice. The basic system 10 includes an absorption tank 20 for containing a refrigerant and an absorbant mixture composition. Both the refrigerant and absorbant material compositions will be discussed in greater detail below. The refrigerant and absorbant mixture composition is drawn from absorption tank 20 by pump 30 and is delivered to first heat exchanger 40. Pump 30 drives the high pressure mixture through heat exchanger 40 in order to pre-heat the mixture. The pre-heated mixture flows from heat exchanger 40 into boiler 50. In boiler 50, the refrigerant is vaporized and is drawn off in gaseous form (represented by the dotted line). The liquid absorbant is removed from boiler 50 and drawn back into heat exchanger 40 in order to cool the liquid absorbant. The liquid absorbant passes through an expansion valve 60, where it is depressurized and lowered in temperature, and flows back into absorption tank 20.

The vaporized refrigerant may pass into a power generation sub-system 70. In power generation sub-system 70, the vaporized refrigerant flows into a scroll expander 80, causing the scroll expander 80 to rotate and drive generator 90 via the rotation of shaft 100. The power generation sub-system 70 is optional and may be bypassed, with the vaporized refrigerant passing directly into a closed-loop thermal exchange system, which may be used either for heating or cooling ambient air. The closed-loop thermal exchange system will be discussed, for both a heating cycle and a cooling cycle, in greater detail below.

II. Preferred Embodiment for Hybrid Organic Absorption/Rankine Scroll Electric System Based on Chloroalkane and Dibutyltriethyleneglycol The thermal exchange system 500 shown in FIG. 1 includes an absorption tank 510 for containing a mixture of a refrigerant and an absorbant composition. In the preferred embodiment, the refrigerant is a chlorinated alkane like 1-chloro, 1, 2, 2, 2-tetrafluoroethane, also known as HCFC-124. The refrigerant may further be methylene chloride, also known as dichloromethane, or mixtures of these, or further other HCFC, HFC compositions or chloroalkanes.

In the preferred embodiment, Genosorb® 1843 is utilized as the absorbant. Genosorb® 1843 is a polyglycol dibutyl ether and is used to physically absorb non-polar compounds, such as aromatics and hydrocarbons. The specific compositions for the absorbant and refrigerant are further discussed in Section V of the Application, related to the specific compositions.

Figure 1:
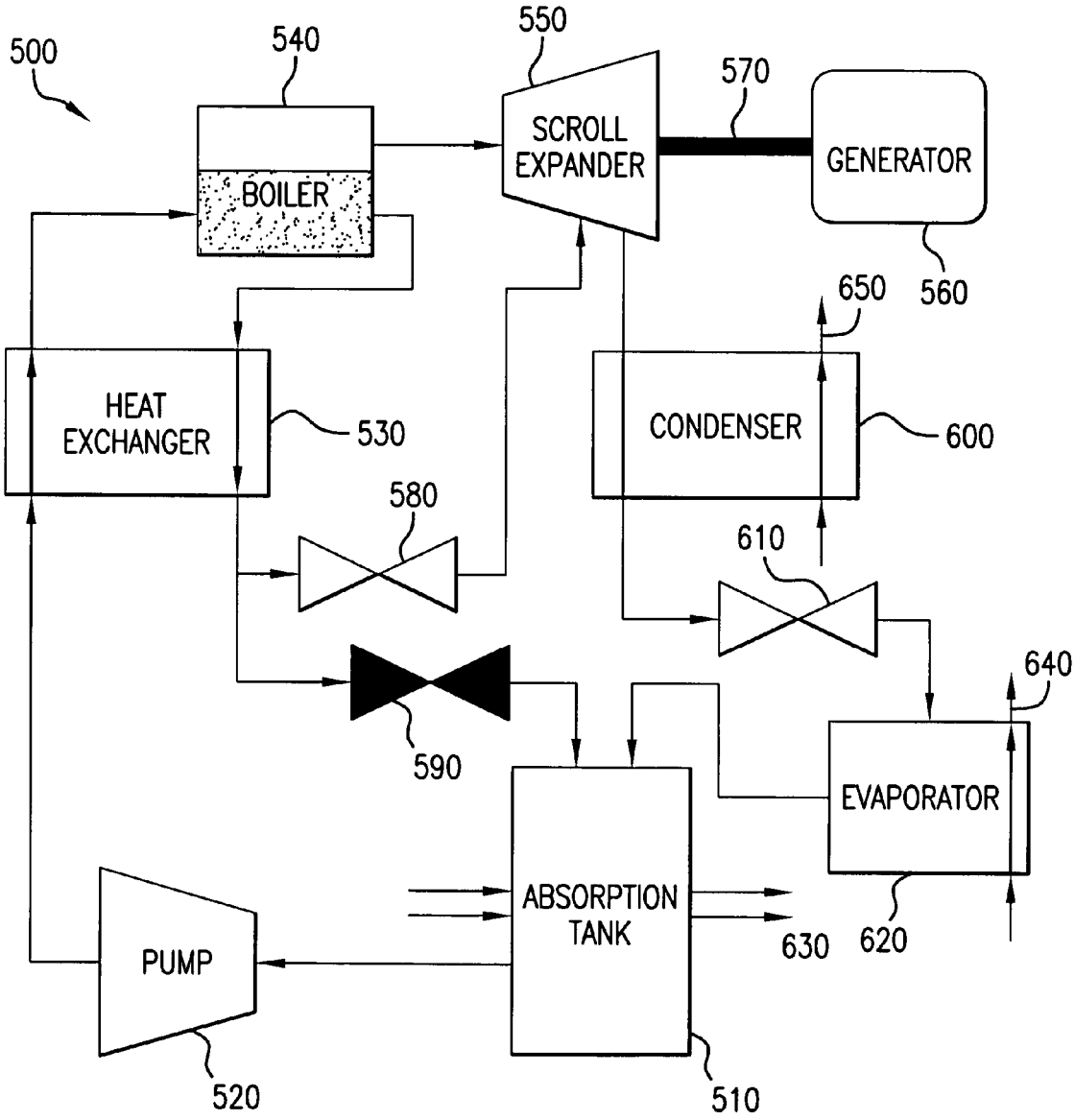
FIG. 1 is a schematic representation of the preferred embodiment of the subject heating/cooling and power generation system.

Referring to FIG. 1, an electric fuel pump 520 pumps the mixture of absorbant and refrigerant from absorption tank 510, with the mixture being pressurized to a pressure of approximately 60-150 psi.

The mixture is delivered to a counter-flow liquid-liquid heat exchanger 530, where the mixture is pre-heated. When the mixture exits heat exchanger 530, the mixture has a temperature of approximately 90° C.

The mixture is delivered to boiler 540, which boils the mixture of refrigerant and absorbant at a pressure of approximately 60-150 psi. Because the HCFC 124 is dissolved in the Genosorb®, it has a lower pressure than pure HCFC 124 (also known as R124) would have at the same temperature. As R124 is removed, the solution must be heated to a higher temperature in order to drive the R124 out so that the liquid mixture exiting the boiler contains R124 in a concentration of approximately 10%. As shown in FIG. 1, the liquid is delivered back into the counter-flow pre-heater and is used to pre-heat the incoming mixture as the hot mixture is cooled within the heat exchanger 530.

Superheated dry R124 vapor exits the boiler 540 and is delivered to the scroll expander 550. The superheated R124 enters the scroll expander and expands with a volumetric expansion ratio of approximately 5. Due to the properties of R124, the pressure ratio achieved is approximately 6.0.

The R124 temperature upon exit from the scroll expander 550 has dropped, at this point in the cycle, to approximately 70° C., and it is this lower temperature R124 vapor which may be used to cool the windings of electric generator 560, which is coupled to scroll expander 550 by shaft 570. The shaft-driven generator 560 may be used to generate electrical power.

In order to improve the lifetime of system 500, a portion of the cooled Genosorb® absorption composition, which has exited boiler 540 and re-entered heat exchanger 530, is rooted into a regulator valve 580, which meters out a small portion of the composition material into scroll expander 550, providing lubrication.

Genosorb® is chosen as the absorbant in the preferred embodiment because Genosorb® compositions are unique in that they are quite thermally stable. They also have low electrical conductivity, which reduces corrosive action and is an essential feature of an absorption material or composition if it is to be used in an electrical generation apparatus.

The thermal stability of the absorbant/refrigerant mixture can be substantially improved by adding certain chemical additives which are well-known in the art. For example, the additive may be a phosphate, a phosphate, a borate, or a zinc dialkyldithiophosphate (ZDDP) compound, such as OLOA 262, manufactured by the Chevron Corporation.

The additives may also be typical oil anti-oxidants, such as a plurality of the oil anti-oxidants which are well-known in the oil-additive arts. These oil additives act to coat surfaces of metal and reduce the tendency of the metal surfaces to catalyze the reaction of the decomposition of the adsorption material and the refrigerant.

Returning to the system 500 of FIG. 1, a larger portion of the concentrated Genosorb® material exiting heat exchanger 530 enters a second pressure reduction valve 590, where it is stepped down to the pressure of the R124 cooler/evaporator 620, further described below.

Returning to the scroll expander 550, R124 vapor exits the scroll expander 550 at approximately 4-6 atmospheres of pressure. This relatively moderate pressure allows the main condenser 600 to be compact. The condenser may be cooled by air or water, shown by arrow 650.

The refrigerant vapor exits the scroll expander 550 and enters condenser 600, where the refrigerant is converted to a liquid by the cooling action of condenser 600.

The cooled and condensed liquid R124 exits the condenser and is directed to a refrigeration expansion valve 610, where the liquid steps down in pressure to approximately 0.5-2.5 atmospheres, providing a cooling effect to air or water entering evaporator 620.

The depressurized liquid exits the expansion valve 610 and enters evaporator 620. Evaporator 620 converts the liquid refrigerant to a vaporized refrigerant. The vaporization is an endothermic reaction, thus providing a cooling effect for the air or water flowing through evaporator 620, illustrated by the arrows 640. The cooled air or liquid 640 exiting evaporator 620 can be rooted within a home, building, or other edifice, thus providing a cooling effect.

The absorption tank 510 is provided with an air-cooled contactor. The air-cooled contactor allows intimate mixing and contact of the R124 vapor and the cool, concentrated Genosorb® absorption solution. The vaporized refrigerant is drawn from evaporator 620 back into the absorption tank 510, containing the air-cooled contactor. The absorption tank 510 further holds the liquid absorbant drawn from the boiler 540 and through valve 590.

The adsorption process of the vaporized refrigerant mixing with the liquid absorbant produces heat, and a fluid material such as air or water flows through the contactor, illustrated by the arrows 630, in order to remove this excess thermal energy. Typically, the contactor performance is improved by operating at as low a temperature as possible. Thus, the air or other fluid 630 entering the contactor within absorption tank 510 is preferably cooled first by, for example, a wick-type water evaporation cooler.

After entering the contactor, the Genosorb® material and R124 have formed the original mixture, which began the cooling cycle, and the mixture, once again, exits the contactor to enter pump 520, thus restarting the cycle.

Due to the fact that the R124 is superheated and expanded at a pressure ratio of approximately 6, the thermodynamic efficiency of the scroll Rankine cycle is expected to be between 10 and 18%. Higher efficiency results if the condenser 600 is operated on a cool day.

As an absorption system, the expected coefficient of performance of system 500 is similar to any other efficient single-effect absorption unit, i.e., approximately 0.6.

If the electric power produced by generator 560 is produced at an efficiency of approximately 14%, and is coupled to an electric compressor and used with conventional equipment with an electrical-to-cooling coefficient of performance of approximately 3.0, the net effect of the overall system in terms of COP is the sum of the absorption unit, 0.6, and the Rankine/electric unit, 0.4, thus giving a net system COP of approximately 1.0.

It should be noted that the boiler temperature of system 500 is substantially higher than would be required of the system operating with only pure R124 as the working fluid.

Pump 520 may be a direct-current driven fuel pump of the in-line type, such as a Walbro Model GSL392, which is able to deliver the required 100 psi of pressure while still being low in cost. Further, brushless DC type fuel pumps, produced by the Visteon Corporation of Dearborn, Mich. are even better suited to thermal systems, such as system 500, since the brushless motor employed has approximately double the lifetime of a brush-type motor.

HFC 124 is chosen as the preferred refrigerant because this material has a normal boiling point of approximately −12.1° C. at atmospheric pressure. This material is readily absorbed by Genosorb® 1843 poly-triethylene glycol. The partial pressure of HCFC 124 at a typical evaporator temperature of 10° C. is about 2.3 atmospheres absolute, or about 1.3 atmospheres (gage pressure), which is considered optimum from the viewpoint of both safety, thermodynamic efficiency, heat transfer characteristics, and a desire to avoid excessive leakage of the material into the environment.

In the preferred embodiment, the scroll expander 550 is either a Bristol scroll compressor, or a Copeland scroll compressor, such as the Glacier Model, with built-in expansion ratio of approximately 5.0. This expansion ratio is nearly optimum when the working fluid for a Rankine cycle with a boiling point of around 110-140° C. is used and when R124 is the working fluid.

The scroll compressor may include separate oil injection ports, however, this will not affect the operation of the system 500.

III. Cooling Cycle

FIG. 2 illustrates the cooling cycle of an alternative embodiment of the heating/cooling system 10. As shown in FIG. 2, following the vaporization of the refrigerant in boiler 50, the vaporized refrigerant is passed through a first selector valve 110. In the cooling cycle of FIG. 2, the selector valve 110 diverts the vaporized refrigerant into a first liquid-vapor converter 130. The liquid-vapor converter acts, essentially, as a condenser and condenses the vaporized refrigerant into the liquid phase of the refrigerant.

The liquid refrigerant is passed through a second expansion valve 140 where the pressure of the liquid refrigerant is dropped to slightly below atmospheric pressure. The depressurized liquid refrigerant passes from the second expansion valve 140 into a second liquid-vapor converter 150. The second liquid-vapor converter 150 re-vaporizes the liquid refrigerant and passes the vaporized refrigerant through a second selector valve 120, which in the cooling cycle, passes the vaporized refrigerant back into absorption tank 20 to form the refrigerant and absorbant mixture composition.

A salt or brine solution is provided with the brine solution passing through liquid-vapor converter 130. When the vaporized refrigerant condenses into the liquid refrigerant within liquid-vapor converter 130, the heat of the vaporized refrigerant is released. This heat is used to heat the brine solution. This heated brine solution then passes into a first air-to-liquid contactor member 170.

When the cooling/heating system 10 is installed in a home or other edifice, the first air-to-liquid contactor member 170 is positioned external to the edifice. Ambient or environmental air is drawn into the first air-to-liquid contactor member 170 and the heated brine solution causes the ambient air to be heated, with the air-to-liquid contactor member 170 expelling heated air into the environment.

The now-cooled brine solution is driven through second heat exchanger 160 by fluid pump 180. The second heat exchanger 160 further cools the brine solution as it is being drawn through by pump 180 and the cooled brine solution is then passed into second liquid-vapor converter 150.

The second liquid-vapor converter 150 converts the liquid refrigerant to vaporized refrigerant, thus requiring thermal energy to be added to the refrigerant. This thermal energy comes from the brine solution driven by pump 180, thus further cooling the brine solution as it passes through second liquid-vapor converter 150.

This cooled brine solution is then driven through second air-to-liquid contactor 190. When the cooling/heating system 10 is installed in a home or other edifice, the second air-to-liquid contactor 190 is installed within the home or edifice and draws in ambient air. The ambient air is cooled by the now-cooled brine solution passing through contactor 190, thus allowing the second air-to-liquid contactor 190 to expel cooled air within the home or edifice.

The brine solution passes from the second air-to-liquid contactor 190 through absorption tank 20, thus heating the brine solution, where it can then be passed through second heat exchanger 160 in order to start the cycle over again.

As the brine solution enters the condenser 130, the heat of condensation of the vapor is transferred to the brine. As the brine enters the condenser 130, the brine is somewhat water-saturated, and that water-saturated brine is heated by the action of the condenser. When the brine exits condenser 130, it is heated and enters the liquid contactor 170. The air-to-liquid contactor 170 is made of a honeycomb absorptive paper or other similar kind of pad material and ambient air enters the liquid-to-air contactor 170 by action of a fan.

Since the brine, at this point, is heated, the brine loses water to the ambient air such that the air exiting the contactor 170 is saturated with water vapor and is further heated.

The brine solution exiting contactor 170 is substantially depleted of water and has a far higher concentration of salt. Upon entering the heat exchanger 160, the brine solution transfers its remaining thermal energy to the incoming water-rich brine solution, thus pre-heating the water-rich brine within heat exchanger 160.

When the water is depleted, brine solution exits heat exchanger 160 in a near ambient-temperature state, it enters brine pump 180. Brine pump 180 directs the brine solution into liquid-vapor converter 150 and as the refrigerant is evaporated, the brine is cooled well below room temperature so that the brine exits on the right-hand side of 150 (in FIG. 2) in a somewhat cold state and is depleted of any moisture.

When the brine solution enters contactor 190, which is located within the building or edifice, the air from the building is blown over the high concentration salt water brine and the air from the building gives up its moisture to the cold brine solution, thus providing a dehumidification effect and a cooling effect on the air going through the contactor 190.

The brine exiting contactor 190 is then slightly cooled and water-rich, which is then directed to the absorption tank 20 where the heat of absorption is removed by the brine solution, and the brine solution exits absorption tank 20 at a temperature of approximately 100° F. The brine solution then flows back into heat exchanger 160 to start the cycle over again.

IV. Heating Cycle

The heating cycle of the alternate cooling/heating system 10 is shown diagrammatically in FIG. 3. As shown in FIG. 3, the vaporized refrigerant, having been vaporized in boiler 50, is passed through first selector valve 110. In the heating cycle, the first selector valve 110 diverts the flow of the vaporized refrigerant through second selector valve 120.

The second selector valve 120 directs the vaporized refrigerant through liquid-vapor converter 150. The second liquid-vapor converter 150 acts, essentially, as a condenser and converts the vaporized refrigerant to a liquid refrigerant. The liquid refrigerant is then passed through the second expansion valve 140 where it is depressurized.

The newly-depressurized liquid refrigerant is then driven through the first liquid-vapor converter 130 where the refrigerant is re-vaporized. The re-vaporized refrigerant then passes back through first selector valve 110 where it is directed to second selector valve 120. Second selector valve 120 passes the vaporized refrigerant back into absorption tank 20, where it mixes with the absorbant to form the refrigerant and absorbant mixture composition.

When the liquid refrigerant passes through the first liquid-vapor converter 130, thus converting the liquid refrigerant to a vaporized refrigerant, the conversion requires the addition of thermal energy. Thus, as the brine solution passes through the liquid-vapor converter 130, it is cooled, having given up thermal energy to the refrigerant.

The now-cooled brine solution passes through the first air-to-liquid contactor member 170. When the cooling/heating system 10 is installed in a home or other edifice, the first air-to-liquid contactor member 170 is positioned external to the home or edifice. Ambient air is drawn through the first air-to-liquid contactor member 170 and the cooled brine solution causes the air-to-liquid contactor member 170 to expel cooled air, thus heating the brine solution.

The now-heated brine solution is passed through second heat exchanger 160, which heats the brine solution and the heated brine solution is driven by pump 14 into second liquid-vapor converter 150. As the vaporized refrigerant is passed through second liquid-vapor converter 150, converting the vaporized refrigerant into a liquid, thermal energy is generated by the conversion process. This thermal energy further heats the brine solution, which is then driven into second air-to-liquid contactor member 190.

When the cooling/heating system 10 is installed in a home or other edifice, the second air-to-liquid contactor member 190 is installed within the home or edifice and the heated brine solution causes the second air-to-liquid contactor 190 to draw in air, which is heated by the brine solution, and expelled heated air within the home or edifice.

The brine solution then passes back through absorption tank 20, thus further cooling the brine solution, where it is then passed back through heat exchanger 160 to begin the cycle again.

In the heating cycle, the condensing vapor in liquid-vapor converter 150 gives up its heat to the water-rich brine entering the converter 150. The water-rich brine is heated at this point. Similarly, the evaporator 130 of the heating cycle chills the concentrated brine solution. The concentrated brine at this point is quite cold and exits the liquid-vapor converter 130, flowing into the ambient air-to-liquid contactor 170 (similar to the flow in the cooling system) in its cold state and, further, depleted of water. Ambient air in the air contactor 170 flows over the cold and water-depleted brine solution, allowing the brine solution to absorb heat and absorb water vapor from the ambient air, thus resulting in a heated brine solution with an increased water content.

The brine solution exits the contactor 170 and enters heat exchanger 160, which now becomes a pre-heat stage for the brine solution as it passes from the upper left-hand side (referring to FIG. 3) to the bottom left-hand side of heat exchanger 160, which pre-heats the brine passing into pump 180.

Pump 180 directs the brine solution into condenser 150 where the brine is then heated even further by the condensation of the water vapor, thus allowing heated water-rich brine to exit the liquid-vapor converter 150. This heated water-rich brine solution passes to contactor 190 where the ambient air receives the heat of the brine solution and is further humidified by the water-rich brine solution, thus providing humidified warm air to the building or edifice. The brine solution then follows a similar return path through the absorption tank 20, to that of the cooling cycle.

V. Specific Compositions of Absorbant and Refrigerant

The absorbant may be a liquid polymer containing triethylene glycol dibutyl ether. In the preferred embodiment, Genosorb® 1843 is utilized. Genosorb® 1843 is a polyglycol dibutyl ether and is used to physically absorb nonpolar compounds, such as aromatics and hydrocarbons. Genosorb® 1843 is hydrophobic and contains a stabilizer. Genosorb® 1843 is a product of the Clariant Corporation of Mount Holly, N.C.

The refrigerant may be a hydrofluorocarbon or a hydrochlorofluorocarbon refrigerant composition. The refrigerant may consist of HFC 134a, HFC 245 fa, or a combination of the two. Further, the refrigerant may be any of the following compounds: trichlorofluoromethane, dichlorodifluoromethane, chlorodifluoro-methane, difluoromethane, 1,1,2-trichlorotrifluoroethane, 1,2-dichlorotetra-fluoroethane, chloropentafluoroethane, 1,1,1,2-tetrafluoroethane, 1,1-dichloro-1-fluoroethane, 1,1-difluoroethane, and methylene chloride.

The refrigerant is selected from the above group based upon the refrigerant's affinity for Genosorb® 1843. The substances having the highest affinities include chlorodifluoromethane, difluoromethane, and methylene chloride.

The refrigerant may be a mixture of 10% 1, 1-difluoroethane (R152a) and 90% 1, 1, 1, 3, 3-pentafluoropropane (R245fa).

The ozone depletion potential (ODP) and global warming potential (GWP) of various refrigerants is a key issue of concern. R243fa may be used as a low ODP working fluid in a Rankine power cycle. However, R243fa has a substantial GWP of around 990 in comparison to carbon dioxide. Additionally, R243fa is non-flammable. Thus, the possibility exists for using R243fa as a refrigerant, but it has a boiling point of around 15° C., which is generally considered to be too high for most air conditioning applications, where typical evaporation temperature is around 10° C.

R152a, or HFC 152a, have the advantage of having zero ODP and a GWP of 140. However, HFC 152a is a flammable gas. A container of pure HFC 152a can easily be ignited and the product of ignition is the hazardous material hydrogen fluoride, which is harmful to humans and also corrosive. Pure R152a has low toxicity and its OSHA limit of exposure is equal to other non-toxic Freon gases; i.e., approximately 1000 ppm.

When mixed together, however, in a mixture ratio of approximately 5% to 25% of R152a with approximately 95% to 75% R243fa, with the most preferable ratio being approximately 10% R152a and 90% R243fa, an optimal refrigerant mixture is produced.

The mixture is essentially non-flammable and is far less flammable than R152a on its own, and the mixture has a substantially lower boiling point than R243fa on its own, and in the preferred ratio has a boiling point of approximately 2° to 4° C. Additionally, the vapor pressure of the mixture is slightly above atmospheric pressure, over the "glide" range, of approximately 3° to approximately 10° C.

The GWP of the mixture is substantially lower than the GWP of pure R243fa and when used in conjunction with Genosorb® 1843, the resulting system pressure is slightly below atmospheric pressure during times when the system is not in operation. Thus, the loss of the mixture is essentially zero during the time of non-operation, which represents the vast majority of hours over the life of a typical air conditioning system.

Additionally, because the pressure of the mixture is higher than the vapor pressure of pure R243fa, the mechanical output power of the expander device of system 10 is higher. This results in a lower cost per peak output power and a more economical system. Additionally, both R152a and R243fa are absorbed efficiently by the preferred absorption material, Genosorb® 1843.

The proportions of the preferred mixture can be optimized for particular locations. For example, in cold climates, the ratio of R152a may be increased to approximately 13% to 20%. In warm climates, the optimal mixture will be lower, typically from approximately 3% to 9%. Such "tuning" of the refrigerant would be impossible with this system utilizing only a single pure material, such as R243fa or R152a alone.

Another advantage of this mixture is that the toxicity of the mixture is lower than the toxicity of pure R243fa. The mixture is further particularly advantageous for systems where a vapor ejector is the device used for utilizing the expansion energy. This is because the average molecular weight of the hot vapor is nearly equal to the molecular weight of pure R243fa, while the average molecular weight of the "pumped gas" can be arranged to be closer to the molecular weight of R152a. The absorption material, Genosorb® 1843, has a higher affinity for R243fa than for R152a, and as a result, the lower pressure working mixture in the evaporator will be higher in concentration in the R152a than in R243fa. Since the molecular weight of R152a is only 33, while the molecular weight of R243fa is 134, the large difference in molecular weight results in the highly efficient pumping of R152a refrigerant by the motive gas consisting primarily of R243fa.

Additionally, the change in entropy of the mixture as pressure is changed is such that the entropy decreases as the pressure decreases. This means that the mixture is "dry" as it expands in either type of expander. This feature is important both in the application of the scroll expander and in the application of a vapor jet pump.

As a further advantage, the refrigerant mixture of R243fa, R152a, and Genosorb® 1843 is that the mixture is completely compatible with all materials of construction of the system 10. Therefore, the system can be entirely hermetically sealed. The specific characteristics of Genosorb® 1843 and the refrigerants include the feature of having very low electrical conductivity, and no tendency to attack materials such as wires, insulation, bearings, etc.

In the preferred embodiment, chlorotetrafluoroethane (HCFC 124) is used as the preferred refrigerant. Though HCF 245fa may be utilized, as described above, in combination with Genosorb® 1843, HFC 245fa has a poor attraction to the Genosorb® 1843 molecule. Neither the HFC 152a nor the HFC 245fa have chlorine molecules in their molecular make-up.

Chloride-containing refrigerant molecules result in far greater attraction between a refrigerant and other molecules because the hydrogen bond is stronger. Thus, HFC 124a will provide a stronger attraction, and thus better refrigerant qualities in the mixture, with Genosorb® 1843. Additionally, compounds such as phosphites and zinc compounds may be utilized as additives in order to reduce interaction between the refrigerant and absorption compounds.

With regard to the brine solution, the brine solution may be a salt dissolved in water. The salt may be lithium chloride, lithium bromide, magnesium chloride, calcium chloride, or glycol.

VI. Single-Effect Absorption Cycle

Figure 4:
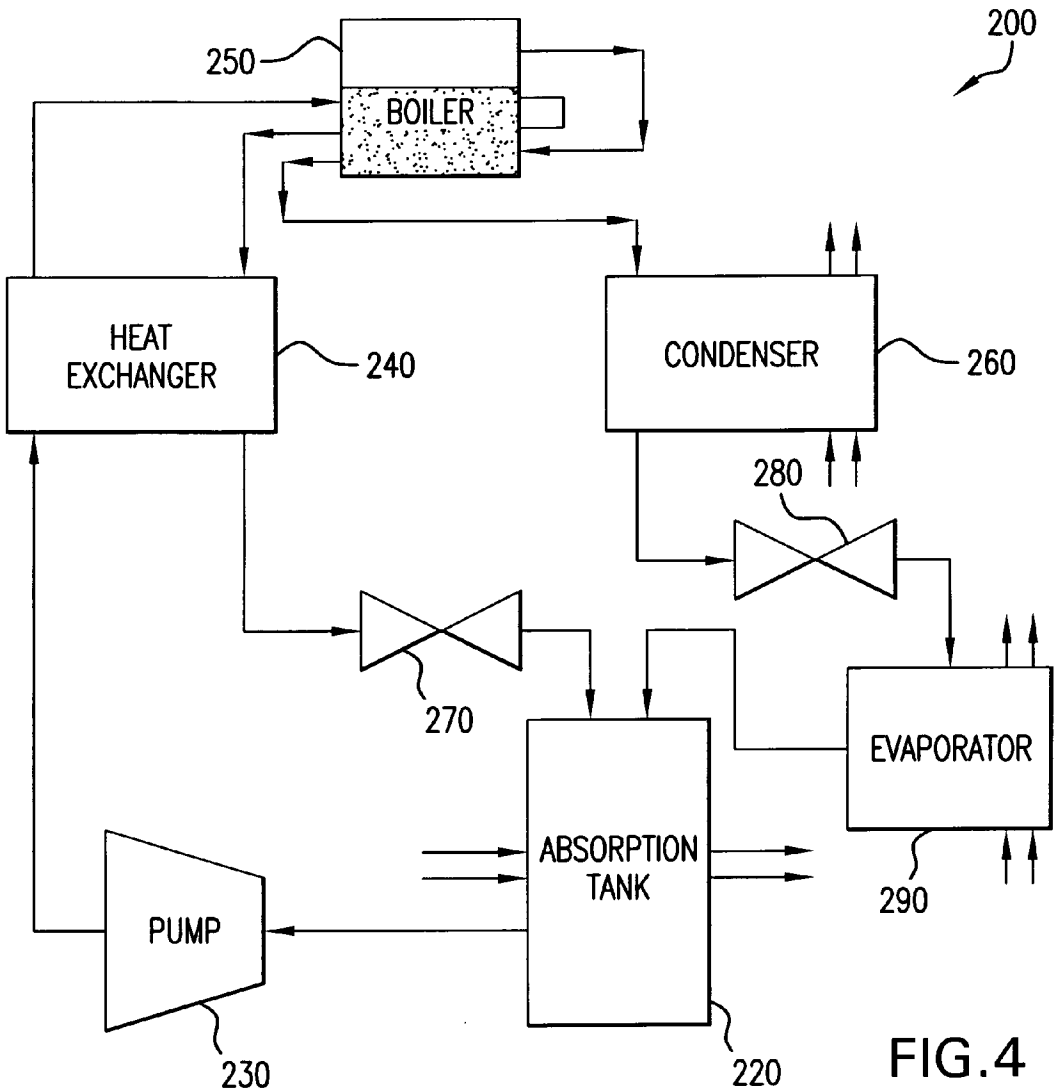
FIG. 4 is a schematic diagram of an alternative embodiment of the heating/cooling system utilizing a single-effect absorption cycle; and, FIG. 5 is an alternative embodiment of the subject heating/cooling system utilizing a mechanical compressor.

The alternative embodiment of FIG. 4 is a cooling system utilizing the specific absorbant and refrigerant compounds discussed above in Section V. As shown in FIG. 4, the absorbant and refrigerant mixture is pressurized by a pump 230, similar to the pump used in system 10 of FIGS. 2 and 3. The initial pumping occurs at essentially constant temperature (approximately 40° C.) and enthalpy. The mixture is held at a pressure of approximately 4 atmospheres absolute, or approximately 3 atmospheres "gage" pressure, which is approximately 45 psig.

The mixture is passed through heat exchanger 240 into boiler 250. Once in the boiler 250, the refrigerant mixture of 10% R152a and 90% R243fa, described above in Section V, is driven off from the absorption fluid (Genosorb® 1843). The concentration of the refrigerant mix is reduced from approximately 40% refrigerant to approximately 12.5% refrigerant. This process takes considerably higher temperature heat than the temperature required for boiling pure fluid, because the refrigerant concentration is only present in a relatively small fraction (one part in 1.5, at the start, and about one part in 9 at the end of the process).

As an approximation, the "activity" of the refrigerant mix is about 1.0 (it is actually slightly higher for R152a and slightly lower for R243fa, but these factors are being left out in the estimate). To produce an absolute pressure of 4 atmospheres with a concentration of 40%, the mixture must be heated to a temperature where the pure material is (1/0.4)×4 atm=10 atm. These conditions occur at a temperature of approximately 75° C.

The mixture at this temperature begins to give off refrigerant mixture vapor at 4 atmospheres of pressure. At the end of the boiling process, the effective temperature must be such that the effective pure mixture has a vapor pressure of (1/0.125)×4 atm=32 atm. This occurs when the pure mixture temperature is approximately 135° C.

As shown in FIG. 4, boiler 250 is constructed such that the hot vapor exit makes a loop back through the boiler, allowing the hot vapor to cool and give up its heat to the boiler process. Similarly, the liquid exiting at the hot end of the boiler also gives up its heat by looping back through the boiler 250.

Upon exiting the boiler, the refrigerant vapor is superheated to approximately 80° C. Superheated vapor exits the boiler and enters the condenser device 260, which is similar in construction to the liquid-vapor converter 130 of the embodiment of FIGS. 2 and 3. The liquid absorbant is drawn from boiler 250 back through the heat exchanger 240 and through expansion valve 270 in order to return to the absorption tank 220, in a similar process to that shown in FIGS. 2 and 3.

Once in the liquid-vapor converter or condenser 260, the vapor is condensed and heat is given up to the environment by air flowing through the condenser 260. Exiting the condenser, the liquid refrigerant mix expands adiabatically and at constant enthalpy in expansion valve 280.

The vapor mixture is now at a state between liquid and vapor. The "quality" of this mixture is estimated to be approximately 80% liquid and 20% vapor at a temperature of approximately 2° C. and at a pressure of 1 atmosphere. The cool mixture evaporates completely with an evaporator 290, which is similar to the second liquid-vapor converter 150 of the embodiment shown in FIGS. 2 and 3. The pressure of the evaporant remains at 1 atmosphere.

The mixture of R243fa and R152a reaches a total vapor state after its temperature is increased from approximately 2° C. to approximately 10° C. This expansion process absorbs heat, thus creating a cooling effect for air passing through the evaporator 290. The vapor mixture at this point is at approximately 1 atmosphere of pressure and approximately 10° C., and has a "quality" of 100%.

The vapor is then directed back into the absorption tank 220, where it mixes with the Genosorb® 1843, which is also at a pressure of approximately 1 atmosphere, and at near room temperature.

The Genosorb®, at this point, has been depleted to approximately 10% refrigerant mix by the boiling process. The Genosorb® then absorbs the refrigerant mixture, releasing heat. The final concentration of the refrigerant mix in the Genosorb® material is approximately 40%. The mixture of refrigerant and Genosorb® is then pressurized by the pump 230 from approximately 1 atmosphere to about 4 atmospheres, and the process is repeated.

VII. Shaft-Coupled Mechanical Compressor System

In the embodiment shown in FIGS. 2 and 3, a scroll expander 80 is coupled to an induction generator 90 by shaft 100. In the alternative embodiment shown in FIG. 5, the mechanical output of a scroll compressor is used to drive a mechanical compressor, which may be of the scroll type.

In a cooling mode, a mixture of refrigerant and absorbant, as described above with regard to FIGS. 2 and 3, and in the embodiment of FIG. 4, is held within an absorption tank 320. The mixture is driven by pump 330 through a heat exchanger 340. The mixture is then delivered to a boiler unit 350 where the refrigerant is vaporized and the liquid absorbant is driven back through heat exchanger 340, through expansion valve 360 and back into the absorption tank 320. This process is the same as in the embodiments of FIGS. 2 and 3, and in the embodiment of FIG. 4.

Figure 5:
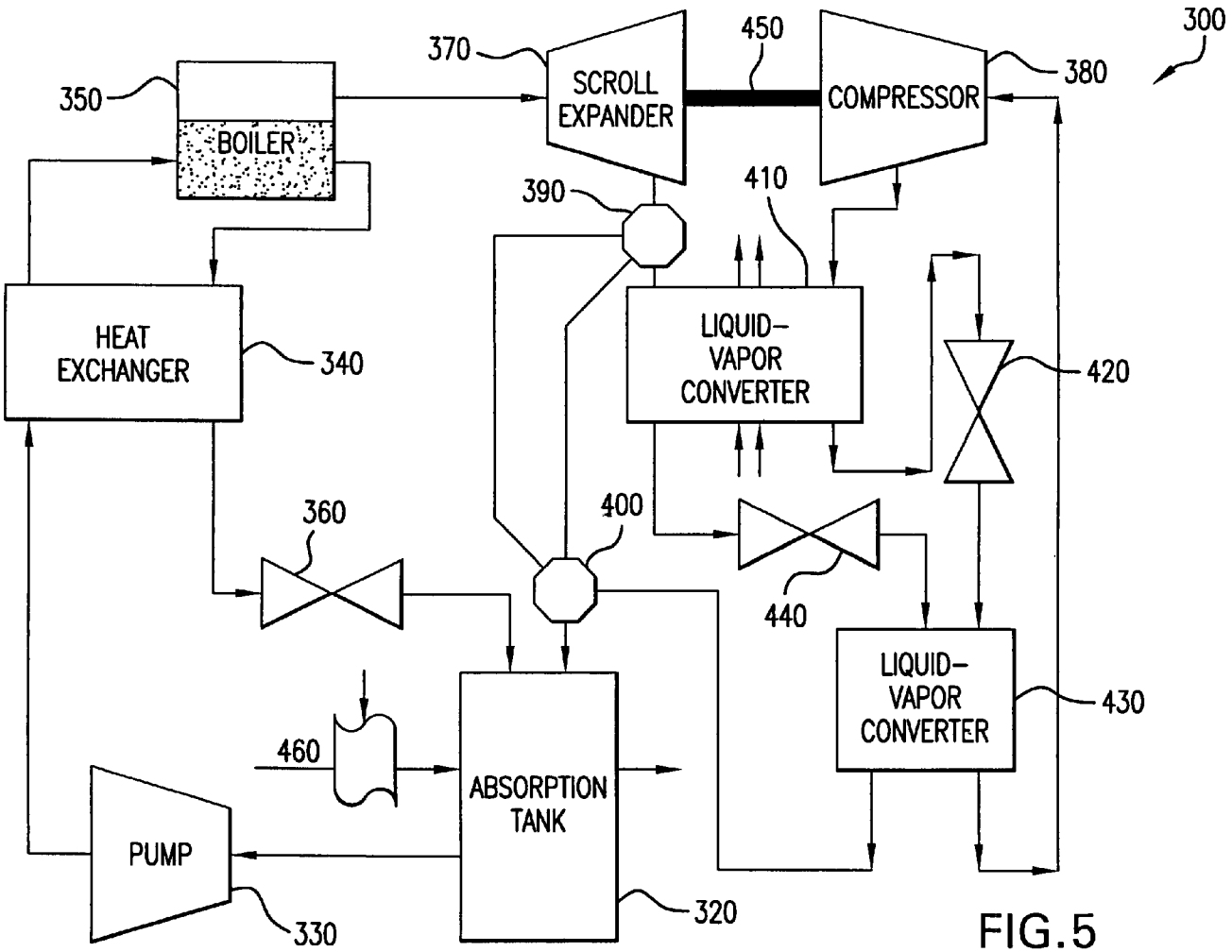

In the embodiment of FIG. 5, the vaporized refrigerant is delivered to a scroll expander 370 which drives a compressor 380 via shaft 450. The compressor 380 elevates the pressure from approximately 1 atmosphere to about 2 to 4 atmospheres, and gaseous refrigerant is expelled by compressor 380 into condenser 410, which is similar to the liquid-vapor converter 130 of the embodiment shown in FIGS. 2 and 3.

The condenser 410 liquefies the vaporized refrigerant, thus releasing heat into ambient air circulating over condenser 410.

The condensed refrigerant is then directed to an expansion valve 420 where the pressure is decreased to approximately 1 atmosphere. The refrigerant passes from the expansion valve 420 to an evaporator 430, which is similar to the second liquid-vapor converter 150 of the embodiment shown in FIGS. 2 and 3. In the evaporator 430, the liquid refrigerant evaporates and absorbs heat. The vapor exits the evaporator 430 and is returned to compressor 380 to begin the cycle over again.

Gaseous refrigerant exiting scroll expander 370 is directed, through first selector valve 390 into condenser 410. As in the embodiment shown in FIGS. 2 and 3, through use of the selector valves 390 and 400, the system can be switched between a heating and cooling mode.

Liquid refrigerant exiting the condenser 410 enters an expansion valve 440, where the liquid refrigerant is depressurized from approximately 4 atmospheres to approximately 1 atmosphere. The liquid refrigerant evaporates within evaporator 430, producing gaseous or vaporized refrigerant.

The vaporized refrigerant then passes through the second selector valve 400 to be input back into the absorbant tank 320, where it is mixed with the absorbant to form the mixture of refrigerant and absorbant.

Following the process of this embodiment, mechanical power is produced, representing approximately 10% of the input heat energy. A typical mechanical compressor using a scroll-type design operates with a mechanical coefficient of performance (COP) of approximately 4 to 6. Thus, in considering the effective refrigeration output vs. heat input, the mechanical "Rankine" cycle portion operates with an effective COP of approximately 0.5.

In addition to the cooling effect produced by the mechanical compressor, cooling is produced in the absorption section. As shown in FIG. 5, air is passed through an air-to-liquid contactor member 460 in communication with the absorption tank 320, in order to produce cooled air. In the heating mode, it is understood that this would produce a heated air effect.

Although this invention has been described in connection with specific forms and embodiments thereof, it will be appreciated that various modifications other than those discussed above may be resorted to without departing from the spirit or scope of the invention. For example, functionally equivalent elements may be substituted for those specifically shown and described, proportional quantities of the elements shown and described may be varied, and in the method steps described, particular steps may be reversed or interposed, all without departing from the spirit or scope of the invention as defined in the appended claims.

What is claimed is:

1. A cooling and power generation system comprising: (a) an absorption tank for containing a refrigerant and an absorbant mixture composition, (b) a pump in fluid communication with said absorption tank for pressurizing said mixture composition to produce a high pressure mixture composition; (c) a heat exchanger fluidly coupled to said pump for passing said high pressure mixture composition therethrough; (d) a boiler for heating said high pressure mixture composition, said boiler vaporizing said refrigerant and egressing on a first boiler conduit line, said heated absorbant being passed to said heat exchanger on a second boiler conduit line for insert into said absorption tank; (e) a scroll expander fluidly coupled to said boiler for receiving said vaporized refrigerant; (f) an induction generator rotationally coupled to said scroll expander for producing electrical power; (g) a condenser for receiving said vaporized refrigerant, said condenser converting said vaporized refrigerant to liquid refrigerant; (h) an evaporator for receiving said liquid refrigerant, said evaporator converting said liquid refrigerant back to said vaporized refrigerant, said conversion of said liquid refrigerant to said vaporized refrigerant drawing thermal energy from the environment, said vaporized refrigerant being returned to said absorption tank to remix with said absorbant.

2. The cooling and power generation system as recited in claim 1 wherein said absorption tank includes an air-to-liquid contactor member for drawing thermal energy from said absorption tank.

3. The cooling and power generation system as recited in claim 1 wherein an expansion valve is positioned between said heat exchanger and said absorption tank to depressurize said absorbant prior to re-insert in said absorption tank.

4. The cooling and power generation system as recited in claim 1 wherein an expansion valve is positioned between said condenser and said evaporator to depressurize said liquid refrigerant prior to entry in said evaporator.

5. The cooling and power generation system as recited in claim 1 wherein said refrigerant is an HFC refrigerant.

6. The cooling and power generation system as recited in claim 1 wherein said refrigerant is an HCFC refrigerant.

7. The cooling and power generation system as recited in claim 1 wherein said absorbant is a liquid polymer containing triethylene glycol dibutyl ether.

8. The cooling and power generation system as recited in claim 1 wherein said absorbant is Genosorb.RTM. 1843.

9. The cooling and power generation system as recited in claim 8 wherein said refrigerant is selected from the group consisting of: HFC 134a, HFC 245 fa, R124, and combinations thereof.

10. The cooling and power generation system as recited in claim 8 wherein said refrigerant is selected from the group consisting of: trichlorofluoromethane, dichlorodifluoromethane, chlorodifluoromethane, difluoromethane, 1,1,2-trichlorotrifluoroethane, 1,2-dichlorotetrafluoroe-thane, chloropentafluoroethane, 1,1,1,2-tetrafluoroethane, 1,1-dichloro-1-fluoroethane, 1,1-difluoroethane, and methylene chloride.

11. A refrigerant and absorbant composition for thermal exchange systems wherein the refrigerant and absorbant compositions are selected from the group of Genosorb.RTM. 1843 and HCFC 124 in predetermined weight percentages.

* * * * *